US006966726B2

(12) United States Patent
Kawashima

(10) Patent No.: US 6,966,726 B2
(45) Date of Patent: Nov. 22, 2005

(54) BUOYANCY COMPENSATOR

(75) Inventor: Haruo Kawashima, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/954,289

(22) Filed: Oct. 1, 2004

(65) Prior Publication Data

US 2005/0074295 A1 Apr. 7, 2005

(30) Foreign Application Priority Data

Oct. 7, 2003 (JP) ..... 2003-348761

(51) Int. Cl.[7] ..... B63C 11/02
(52) U.S. Cl. ..... 405/186; 405/185; 441/88
(58) Field of Search ..... 405/185–187; 441/88, 108, 106, 111, 112, 136; 114/315, 114/331, 333; 224/191, 934

(56) References Cited

U.S. PATENT DOCUMENTS 4,694,772 A * 9/1987 Faulconer et al. ..... 441/112
5,074,714 A * 12/1991 Franco ..... 114/315
5,205,672 A * 4/1993 Stinton ..... 405/186
5,516,234 A * 5/1996 Duchesne ..... 405/186
5,641,247 A 6/1997 Seligman
5,746,542 A * 5/1998 Carmichael ..... 224/934
5,860,769 A * 1/1999 Seligman ..... 405/186
5,913,640 A * 6/1999 Bortner ..... 441/88
5,944,450 A * 8/1999 Anderson ..... 405/186
6,030,147 A * 2/2000 Bowden ..... 441/106
6,749,370 B1 * 6/2004 Urabe et al. ..... 405/185
6,758,635 B1 * 7/2004 Feng ..... 405/186

FOREIGN PATENT DOCUMENTS

EP 1361153 * 11/2003

* cited by examiner

*Primary Examiner*—Jong-Suk Lee
(74) *Attorney, Agent, or Firm*—Clark & Brody

(57) ABSTRACT

A jacket having a buoyancy compensating function has a pocket into which a weight can be inserted and a flap. A first locking member is attached to outer surface of the pocket and a second locking member adapted to be engaged with the first locking member is attached to outer surface of the flap. The second locking member comprises a pair of elastic arms adapted to be guided along grooves of the first locking member and stopper means adapted to be forced into a space defined between these elastic arms and thereby to prevent the elastic arms from being elastically deformed. The weight is provided with a band strip adapted to extend outward from the pocket through a gap defined between the first locking member and the stopper means after the weight has been inserted into the pocket.

2 Claims, 8 Drawing Sheets

BUOYANCY COMPENSATOR

This application claims foreign priority from Japanese Patent Application No. 2003-348761 filed Oct. 7, 2003, the disclosure of which is hereby incorporated by the reference.

BACKGROUND OF THE INVENTION

The present invention relates to a buoyancy compensator for diving and more particularly to such a buoyancy compensator including a weight for buoyancy compensation.

U.S. Pat. No. 5,641,247 (Citation) discloses a buoyancy compensator having a pocket into and from which a weight can be inserted and withdrawn, respectively. The pocket is provided on its outer surface with a hook-member cooperating with a loop member to constitute a so-called mechanical fastener, and a bag used to contain the weight therein is formed with a flap adapted to extend outward from the pocket when the bag is inserted into the pocket. A loop member is attached to the surface of the flap destined to face the hook member on the pocket when the flap is folded back so that the flap may be pressed against the outer surface of the pocket to bring the hook member in engagement with the loop member and thereby to prevent the weight from falling off. The flap may be intentionally unfolded to disengage the hook member from the loop member and thereby to withdraw the weight from the pocket.

While the buoyancy compensator is certainly advantageous in that the weight can be reliably held within the pocket and easily withdrawn from the pocket, the weight operatively inserted into the pocket is limited to that having means by which the weight is fastened to the pocket, e.g., the loop member attached to the flap.

SUMMARY OF THE INVENTION

In view of the problem as has been described above, it is a principal object of the present invention to provide a buoyancy compensator improved so that various types of weight including also the weight having no means by which the weight is fastened to the pocket may be selectively used and the weight may be easily withdrawn from the pocket.

The object set forth above is achieved, according to the present invention, by an improvement in a buoyancy compensator comprising a pocket extending in a jacket having a buoyancy compensating function in a waist-surrounding direction of the jacket wearer and provided with an opening put aside toward a front side of the jacket, a flap extending from the front side to a backside of the jacket so as to open and close the opening as occasion demands and a weight for buoyancy compensation adapted to be inserted into the pocket in a withdrawable manner.

The buoyancy compensator further comprises the following.

The weight is provided with a band strip for withdrawal of the weight having a sufficient length to extend toward the backside from the opening of the pocket further than the flap after the weight has been inserted into the pocket and the flap has been folded back in the waist-surrounding direction to close the opening. The jacket is provided on outer surface of the pocket with a first locking member and on outer surface of the flap with a second locking member adapted to be releasably engaged with the first locking member. The first locking member has a pair of grooves lying on both sides opposed to each other in a transverse direction of the band strip having been folded back and extending along the band strip from the front side to the backside, the grooves being configured so that respective openings and bottoms of the grooves extending in a longitudinal direction of these grooves are opposed to each other in the transverse direction and a pair of width-enlarged regions spaced from each other by a larger distance in the transverse direction are defined ahead of respective distal ends of the bottom extending toward the backside. The second locking member, in a state of the flap having the opening closed, comprises a pair of elastic arms extending from the front side toward the backside and adapted to be retractably advanced from the front side into respective the grooves and stopper means adapted to be movable between the pair of elastic arms from the front side toward the backside and from the backside toward the front side, the pair of elastic arms being spaced from each other in the transverse direction by a distance larger than a width of the band strip, the pair of elastic members being formed on respective distal ends with projections projecting outward in the transverse direction so that the projections are pressed in the transverse direction against respective the bottoms as the elastic arms are engaged with respective the grooves, resulting in that the elastic arms are deformed so as to get nearer to each other and thereby to reduce the distance, and the projections deform the elastic arms so as to enlarge the reduced distance between the elastic arms to the initial distance as the projections are advanced beyond the distal ends of respective the bottoms to the width-enlarged regions. The stopper means having moved toward the backside ensures a width sufficient to lie in the vicinity of the distal ends of the elastic arms having been advanced into the width-enlarged regions and to come in engagement with the pair of elastic arms which are elastically biased to be deformed so as to get nearer to each other in order that said engagement may reliably prevent the projections from moving apart from the width-enlarged regions and thereby maintain the first and second locking members in engagement with each other.

With the buoyancy compensator constructed in the manner as has been described above, the flap may be closed after the weight has been inserted into the pocket and then the stopper means may be used to engage the first and second locking members with each other to prevent the weight from falling off. To withdraw the weight from the pocket, the stopper means may be manually operated to move toward the front side in the waist-surrounding direction and thereby the flap may be opened.

According to one preferred embodiment of the present invention, the distal end of the band strip having been folded toward the backside lies further behind the stopper means having been moved toward the backside in the second locking member engaged with the first locking member and the band strip may be pulled toward the front side with the distal end unfolded to move the stopper means toward the front side and then to disengage the second locking member from the first locking member.

With the buoyancy compensator of such arrangement, the second locking member including the stopper means may be moved in entirety toward the front side by pulling the band strip attached to the weight to open the flap and then to withdraw the weight from the pocket.

DETAILED DESCRIPTION OF THE PREFERRED EMBODIMENTS

Details of the buoyancy compensator according to the present invention will be more fully understood from the description given hereunder in reference with the accompanying drawings.

Figure 1:
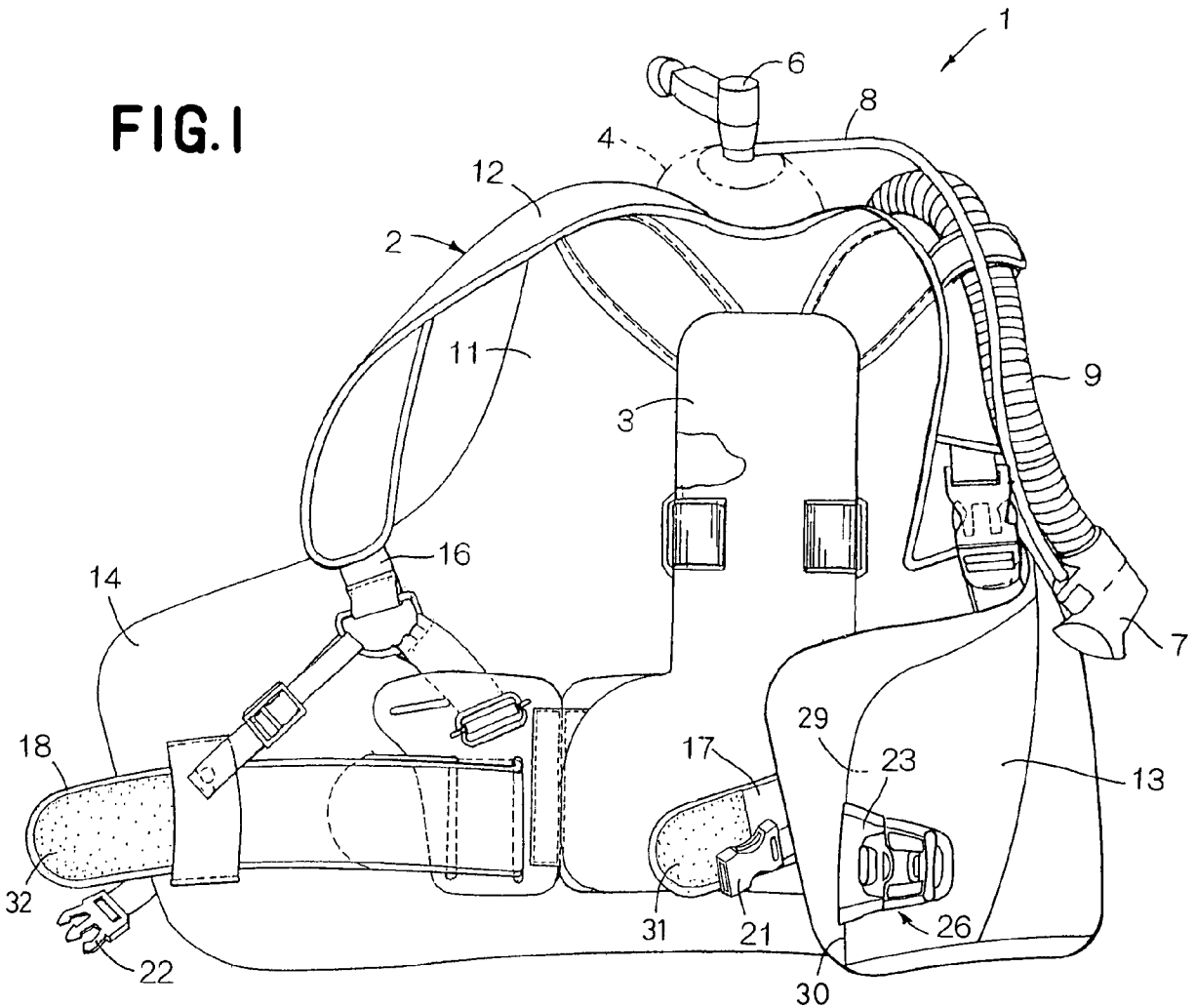
FIG. 1 is a front view of the buoyancy compensator according to the invention.

A buoyancy compensator 1 shown in FIG. 1 comprises a jacket 2, a harness 3 attached to a backside of the jacket 2, a pressure reducing valve 6 attached to an air cylinder 4 indicated by imaginary lines, an air hose segment 8 extending from the pressure reducing valve 6 to a mouthpiece 7 and an air hose segment 9 extending from the mouthpiece 7 to a shoulder of the jacket 2. The jacket 2 comprises a back pad 11, shoulder regions 12, a left waist region 13 and a right waist region 14. The shoulder regions 12 are provided with shoulder belts 16, respectively, and the left and right waist regions 13, 14 are provided with waist belts 17, 18 and female and male fasteners 21, 22, respectively. Except detailed structures of the waist belts 17, 18 and the female and male fasteners 21, 22, the left and right waist regions are substantially similar to each other. Referring to FIG. 1, the left waist region 13 has its outer side illustrated and the right waist region 14 has its inner side illustrated. In the left waist region 13, a weight insertion pocket 29 has its opening 30 closed by a flap 23 which is locked by a locking member 26 adapted to prevent the flap 23 from being unintentionally opened.

After the jacket 2 including such buoyancy compensator 1 has been put on a user's body, the waist belts 17, 18 are connected to each other by using mechanical fasteners 31, 32 attached to distal ends of the respective waist belts 17, 18 and then the female and male fasteners 21, 22 are connected to each other. Thereupon it is possible for the jacket 2 to achieve an appropriate buoyancy compensation by supplying the air from the air cylinder 4 attached to the harness 3 through the air hose segments 8, 9.

Figure 2:
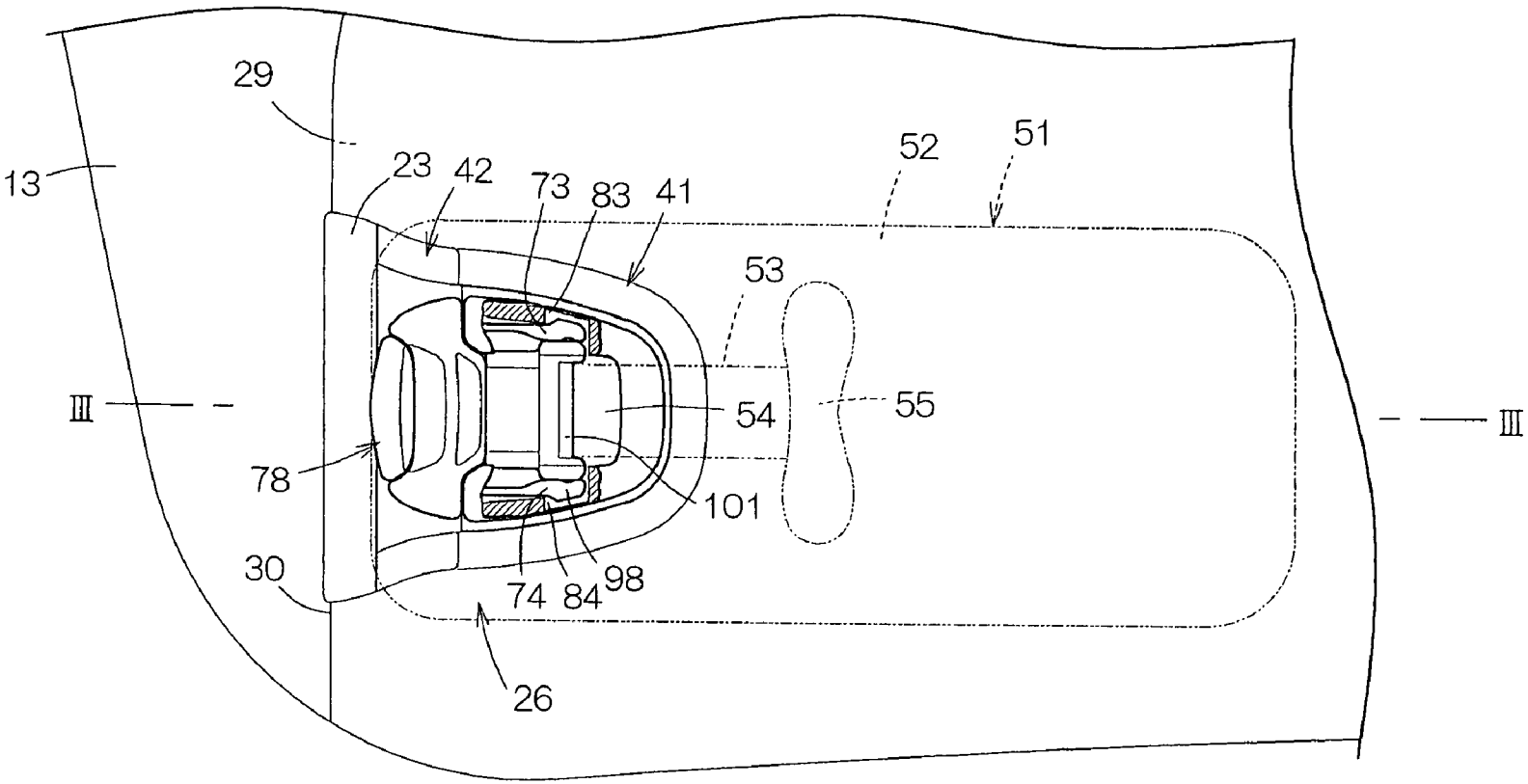
FIG. 2 is a view showing a part of FIG. 1 in an enlarged scale.
Figure 3:
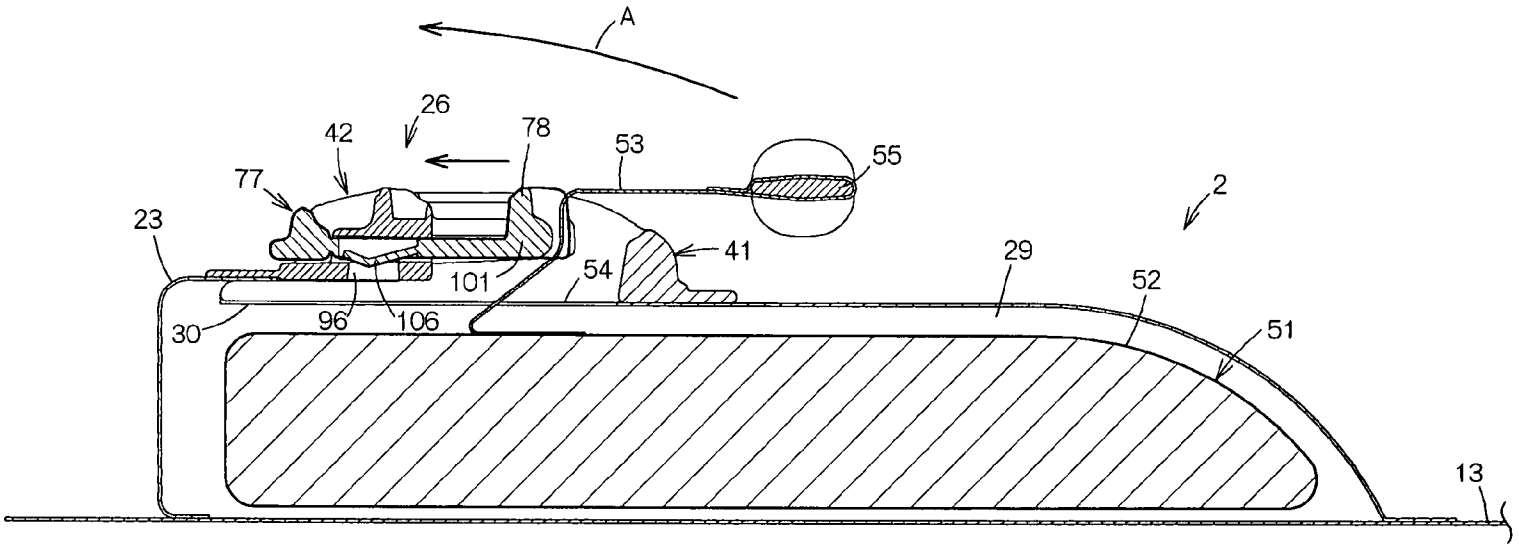
FIG. 3 is a sectional view taken along the line III—III in FIG. 2.

FIG. 2 is a view showing a part of FIG. 1 in an enlarged scale and FIG. 3 is a sectional view taken along the line III—III in FIG. 2. FIG. 2 shows a first locking member 41 as partially cut away and indicates a weight 51 by an imaginary line for easier understanding of the construction. The left waist region 13 of the jacket 2 is formed with the pocket 29 adapted to hold the weight 51 inserted thereinto and the flap 23 adapted to open and close the opening 30 of the pocket 29. The pocket 29 extends from a front zone toward a rear zone of the left waist region 13 and the first locking member 41 making one part of the locking member 26 is attached to the outer surface of the pocket 29 at a position put aside toward the front zone. The flap 23 extends from the front zone toward the rear zone so that the opening 30 of the pocket 29 can be closed and a second locking member 42 making the other part of the locking member 26 is attached to the outer surface of the flap 23 closing the opening 30. Referring to FIGS. 2 and 3, the first and second locking members 41, 42 are engaged with each other so as to lock the flap 23. The flap 23 can be opened unless such locking effect is released. The weight 51 inserted into the pocket 29 comprises a main body 52 and a band strip 53 attached to the main body 52. The band strip 53 extends outward from the pocket 29 through a cut-out 54 (See FIGS. 5 and 6 also) of the outer surface of the pocket 29, then through a gap defined between the first and second locking members 41, 42 and extends rearward. A grip 55 is attached to a distal end of the band strip 53.

Figure 4:
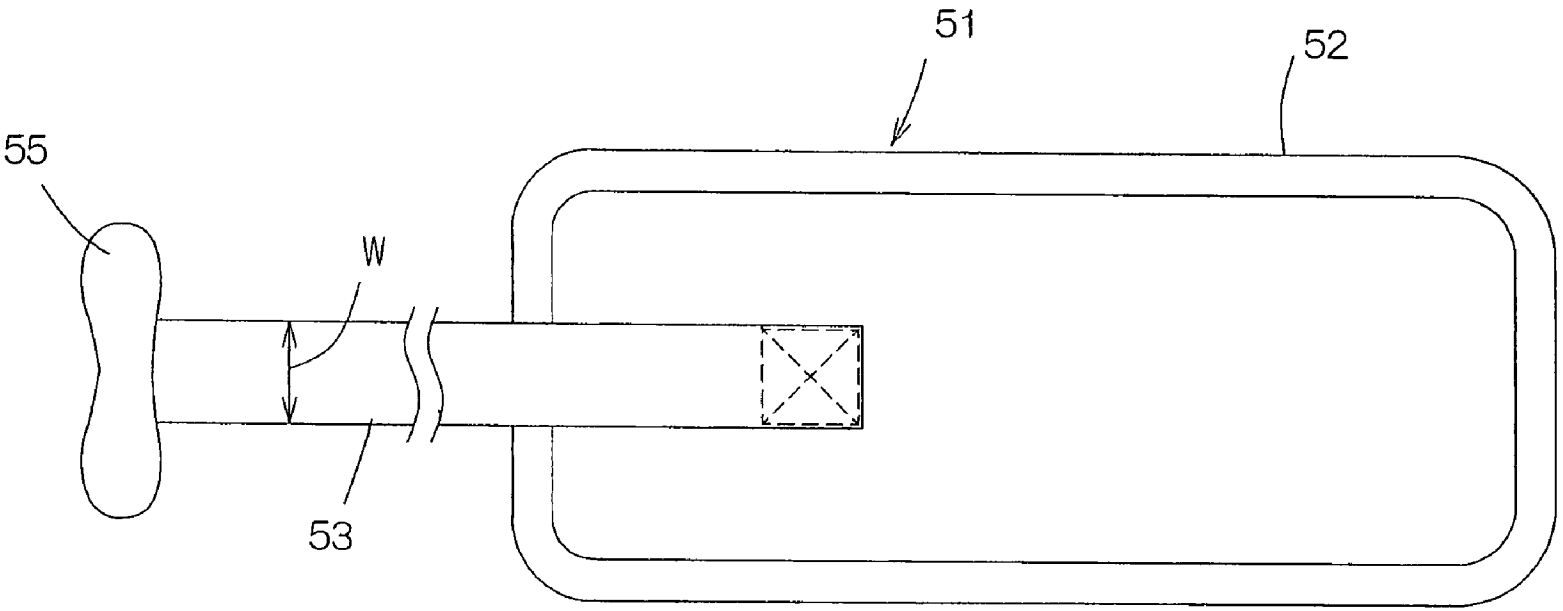
FIG. 4 is a plan view of a weight.

FIG. 4 is a plan view of the weight 51. The main body 52 of the weight 51 comprises a solid metal blank (not shown) wrapped with fabric which is stitched on one end of the band strip 53 made of synthetic fiber. The band strip 53 has a width W and its length is adjusted so that the band strip 53 can extend outward through the cutout 54 of the pocket 29 and then extend rearward as illustrated by FIG. 3.

Figure 5:
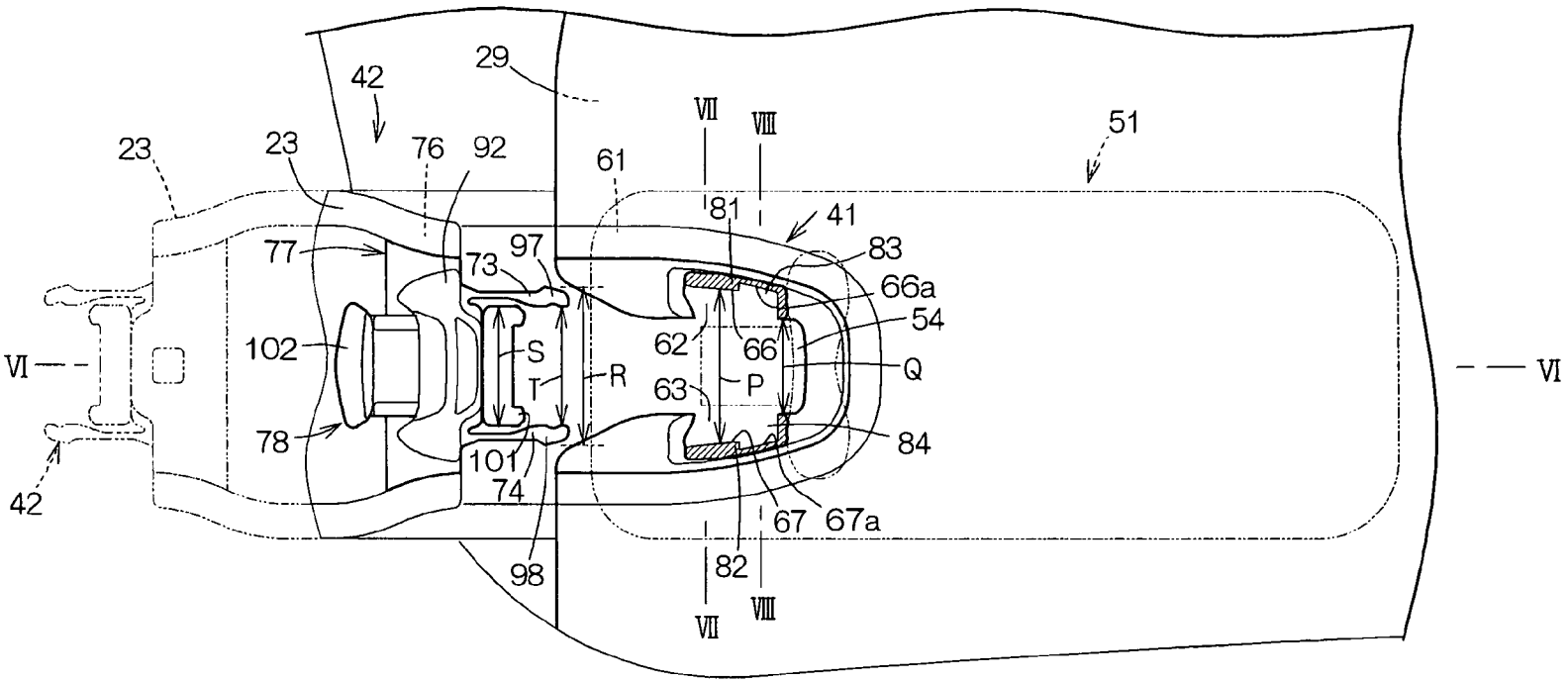
FIG. 5 is a view similar to FIG. 2, showing the buoyancy compensator in its unlocked state.
Figure 6:
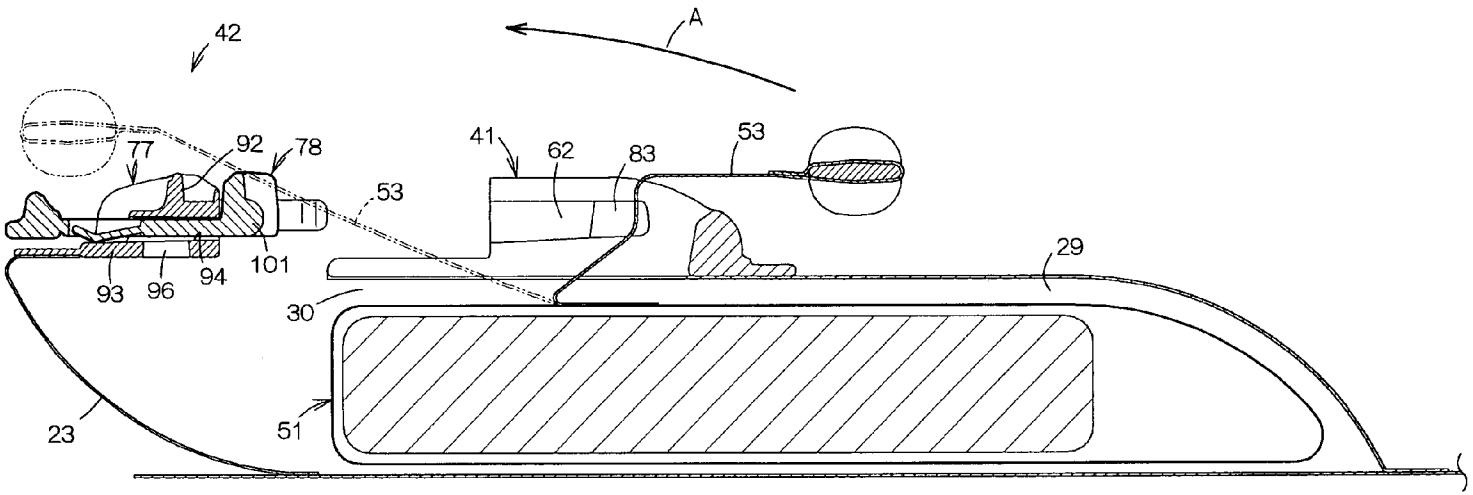
FIG. 6 is a view similar to FIG. 3, showing the buoyancy compensator in its unlocked state.

FIG. 5 is a view similar to FIG. 2, showing the state in which the second locking member 42 has been released from the first locking member 41 as partially cut away and FIG. 6 is a view similar to FIG. 3, showing the state in which the second locking member 42 has been released from the first locking member 41.

Figure 7:
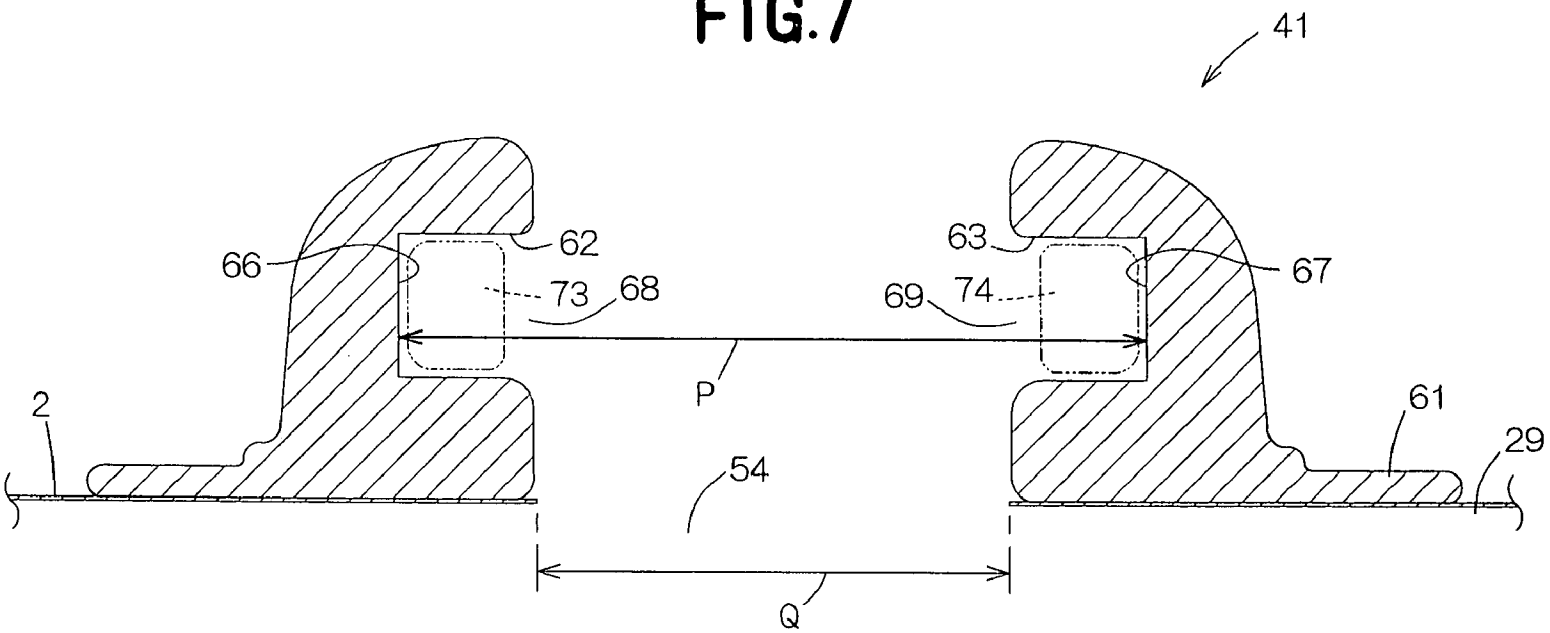
FIG. 7 is a sectional view taken along the line VII—VII in FIG. 5.
Figure 8:
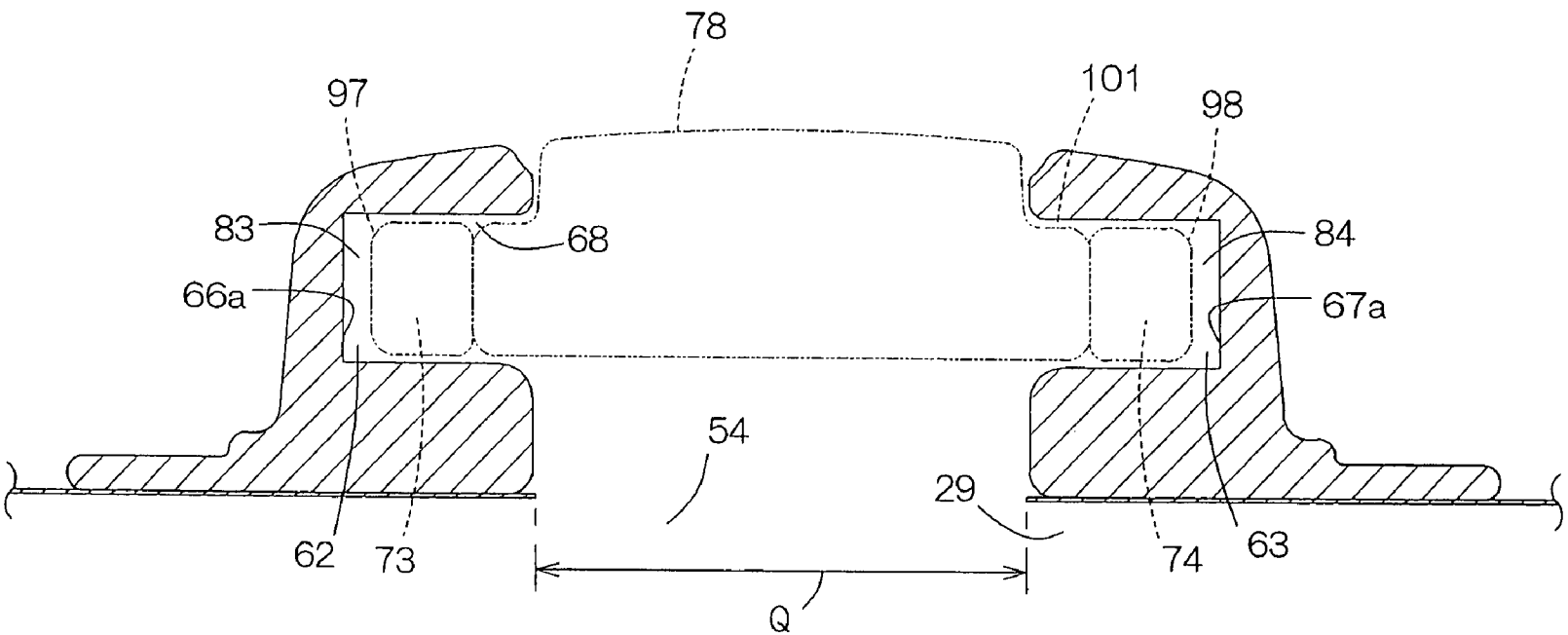
FIG. 8 is a sectional view taken along the line VIII—VIII in FIG. 5.

FIGS. 7 and 8 are sectional views taken along lines VII—VII and VIII—VIII in FIG. 5, respectively, showing the end surface of the first locking member 41 wherein a part of the second locking member 42 is indicated by imaginary lines.

Referring to FIGS. 5 through 8, the first locking member 41 has its peripheral edge 61 fixed to the outer surface of the pocket 29 by means of stitching or the like. Particularly referring to FIG. 5, the first locking member 41 presents a lying-down U-shape and has a pair of guide grooves 62, 63 extending in horizontal direction and opposed to each other in vertical direction as viewed in FIG. 5, i.e., in vertical direction of the jacket 2 (See FIGS. 7 and 8 also). These guide grooves 62, 63 respectively have openings 68, 69 opposed to each other in transverse direction of the first locking member 41. Bottoms 66, 67 of these guide grooves 62, 63 are spaced from each other by a dimension P so far as the respective guide grooves 62, 63 extend rearward along a waist-surrounding direction to points 81, 82. Beyond these points 81, 82, the bottoms 66, 67 of the guide grooves 62, 63 are spaced from each other by a dimension larger than the dimension P so as to define second bottoms 66*a*, 67*a* and thereby to define width-enlarged regions 83, 84. The line VII—VII in FIG. 5 extends across the bottoms 66, 67 and the line VIII—VIII in FIG. 5 extends across the second bottoms 66*a*, 67*a*. The cutout 54 of the pocket 29 has a transverse dimension Q and, in this cutout 54, an edge of the pocket 29 substantially coincides with an edge of the first locking member 41.

The second locking member 42 comprises an insert 77 adapted to be inserted into the first locking member 41 and a stopper 78 attached to the insert 77 so that the stopper 78 fore and aft in the waist-surrounding direction (i.e., left- and rightward as viewed in FIG. 5). The insert 77 is fixed to the flap 23 along its edges 76 by means of stitching or the like and includes a pair of elastic arms 73, 74 extending rearward in the waist-surrounding direction in parallel to each other. As will be apparent from FIG. 6, the insert 77 comprises a top 92, a bottom 93 and a hollow stopper guide 94 defined by the top 92 and the bottom 93. The bottom 93 is formed with a through-hole 96. The respective elastic arms 73, 74 are adapted to be inserted into and drawn off from the guide grooves 62, 63 of the first locking member 41 and formed on respective distal ends thereof with projections 97, 98 projecting outward in the transverse direction of the second locking member 42. A transverse dimension R of the top 92 as measured between the projections 97, 98 is larger than the dimension P by which the respective bottoms 66, 67 of the guide grooves 62, 63 in the first locking member 41. The stopper 78 is movable along a stopper guide 94 toward and from the first locking member 41 and its right end defines contact projections 101 destined to come in contact with the respective arms 73, 74 and its left end defines a grip 102. A transverse dimension S between these contact projections 101 is substantially the same as or slightly larger than a dimension T between the respective distal ends of the elastic arms 73, 74. When the contact projections 101 are positioned aside leftward from the distal ends of the elastic arms 73, 74 as shown in FIG. 5, the elastic arms 73, 74 are deformable so as to get nearer to each other without being obstructed by the stopper 78. With the second locking member 42 in such state, the band strip 53 previously put into the pocket 29 together with the weight 51 is drawn out from the pocket 29 through the cutout 54, then folded back rearward in the waist-surrounding direction and the pair of elastic arms 73, 74 are engaged with the respective guide grooves 62, 63 of the first locking member 41. The elastic arms 73, 74 are deformed so as to get nearer to each other and the dimension R is reduced as the projections 97, 98 come in contact with the bottoms 66, 67 of the guide grooves 62, 63. The projections 97, 98 are moved beyond the points 81, 82 of the bottoms 66, 67 into the width-enlarged regions 83, 84 as the elastic arms 73, 74 are further advanced and thereupon the surfaces of the first and second locking members 41, 42 opposed to each other come in engagement with each other as seen in FIG. 2. In the width-enlarged regions 83, 84, the projections 97, 98 are disengaged from the bottoms 66, 67, respectively, so the elastic arms 73, 74 elastically move to be spaced from each other, i.e., to restore the state shown in FIG. 5. Now the stopper 78 may be inserted into a space between the elastic arms 73, 74 by pushing the grip 102 of the stopper 78 to ensure that the contact projections 101 of the stopper are interposed between the respective distal ends of the elastic arms 73, 74 as will be seen in FIGS. 2 and 8. So long as the stopper 78 is in this state, even if the elastic arms 73, 74 intend to move apart from the respective width-enlarged regions 83, 84, i.e., to get nearer to each other, the elastic arms 73, 74 will bear against the contact projections 101 of the stopper 78 and such movement of the elastic arms 73, 74 will be prevented by these contact projections 101. In this way, the second locking member 42 is maintained in effective engagement with the first locking member 41. In this state, a latch 106 which is elastically deformable in V-shape is received in the through-hole 96 of the insert 77 (See FIG. 3) and therefore it is not apprehended that an elastically deformable latch 106 might be readily moved to release the locking effect.

To release the locking effect between the first and second locking members 41, 42, the band strip 53 shown by FIG. 3 may be folded back and pulled in a direction indicated by an arrow A in FIGS. 3 and 6. The band strip 53 pulled in the direction of the arrow A pushes the contact projections 101 of the stopper 78 in the cutout 54 of the pocket 29 and thereby moves the stopper 78 so that the latch 106 may be withdrawn from the through-hole 96. The stopper 78 thus comes in contact with the insert 77 of the second locking member 42 as shown in FIGS. 5 and 6 and moves this apart from the first locking member 41. Thereupon, the arms 73, 74 are elastically deformed so that the respective projections 97, 98 of these arms 73, 74 may be pressed against the guide grooves 62, 63 in the vicinity of the bottoms 66, 67 from behind as viewed in the waist-surrounding direction and these arms 73, 74 may get nearer to each other, i.e., the projections 97, 98 may be moved apart from the width-enlarged regions 83, 84. In this way, the second locking member 42 is released from engagement with the first locking member 41.

The band strip 53 may be further pulled in the direction of the arrow A to unfold the flap 23 as indicated by the imaginary line in FIG. 5 until the opening 30 of the pocket 29 is fully opened. In this way, the weight 51 can be smoothly withdrawn from the pocket 29.

The buoyancy compensator 1 according to the present invention adopts the flap 23 to close the opening 30 of the pocket 29 as illustrated and therefore the shape as well as the size of the weight is not specified so far as the weight can be inserted into the pocket 29 and reliably held therein. The band strip 53 attached to the weight can be conveniently used not only to release the locking effect established between the locking member on the side of the flap 23 and the locking member on the side of the pocket 29 but also to achieve the subsequent series of operation, i.e., to open the flap 23 and to withdraw the weight 51 from the pocket 29. While the locking member 26 is provided in the left waist region 13, it is possible without departing from the scope of the invention to provide this locking member 26 in the right waist region 14.

The present invention makes it possible to produce the buoyancy compensator improved so that various types of weight may be selectively used and the weight may be easily withdrawn from the pocket.

What is claimed is:

1. A buoyancy compensator comprising:

a pocket extending in a jacket having a buoyancy compensating function in a waist-surrounding direction of the jacket wearer and provided with an opening put aside toward a front side of said jacket;

a flap extending from said front side to a backside of said jacket so as to open and close said opening as occasion demands and a weight for buoyancy compensation adapted to be inserted into said pocket in a withdrawable manner;

said weight being provided with a band strip for withdrawal of said weight having a sufficient length to extend toward said backside from said opening of said pocket further than said flap after said weight has been inserted into said pocket and said flap has been folded back in said waist-surrounding direction to close said opening;

said jacket being provided on outer surface of said pocket with a first locking member and on outer surface of said flap with a second locking member adapted to be releasably engaged with said first locking member;

said first locking member having a pair of grooves lying on both sides opposed to each other in a transverse direction of said band strip having been folded back and extending along said band strip from said front side to said backside, said grooves being configured so that respective openings and bottoms of said grooves extending in a longitudinal direction of said grooves are opposed to each other in said transverse direction and a pair of width-enlarged regions spaced from each other by a larger distance in said transverse direction are defined ahead of respective distal ends of said bottom extending toward said backside;

said second locking member, in a state of said flap having said opening closed, comprising a pair of elastic arms extending from said front side toward said backside and adapted to be retractably advanced from said front side into respective said grooves and stopper means adapted to be movable between said pair of elastic arms from said front side toward said backside and from said backside toward said front side, said pair of elastic arms being spaced from each other in said transverse direction by a distance larger than a width of said band strip, said pair of elastic arms being formed on respective distal ends with projections projecting outward in said transverse direction so that said projections are pressed in said transverse direction against respective said bottoms as said elastic arms are engaged with respective said grooves, resulting in that said elastic arms are deformed so as to get nearer to each other and thereby to reduce said distance, and said projections deform said elastic arms so as to enlarge the reduced distance between said elastic arms to the initial distance as said projections are advanced beyond said distal ends of respective said bottoms to said width-enlarged regions; and said stopper means having moved toward said backside ensures a width sufficient to lie in the vicinity of the distal ends of said elastic arms having been advanced into said width-enlarged regions and to come in engagement with said pair of elastic arms which are elastically biased to be deformed and thereby to get nearer to each other in order that said engagement may reliably prevent said projections from moving apart from said width-enlarged regions and thereby maintain said first and second locking members in engagement with each other.

2. The buoyancy compensator according to claim 1, wherein the distal end of said band strip having been folded toward said backside lies further behind said stopper means having been moved toward said backside in said second locking member engaged with said first locking member and said band strip may be pulled toward said front side with said distal end unfolded to move said stopper means toward said front side and then to disengage said second locking member from said first locking member.

* * * * *